US010814373B2

(12) United States Patent
Yamauchi

(10) Patent No.: US 10,814,373 B2
(45) Date of Patent: Oct. 27, 2020

(54) IRONING MOLDING DEVICE FOR METAL CONTAINER, AND SUPPORT FOR IRONING DIE

(71) Applicant: Norio Yamauchi, Seki (JP)

(72) Inventor: Norio Yamauchi, Seki (JP)

( * ) Notice: Subject to any disclaimer, the term of this patent is extended or adjusted under 35 U.S.C. 154(b) by 464 days.

(21) Appl. No.: 15/550,045

(22) PCT Filed: Feb. 9, 2016

(86) PCT No.: PCT/JP2016/053758
§ 371 (c)(1),
(2) Date: Feb. 1, 2018

(87) PCT Pub. No.: WO2016/129581
PCT Pub. Date: Aug. 18, 2016

(65) Prior Publication Data

US 2018/0141099 A1 May 24, 2018

(30) Foreign Application Priority Data

Feb. 10, 2015 (JP) ..... 2015-024308

(51) Int. Cl.
*B21D 22/28* (2006.01)
*B21D 51/26* (2006.01)

(52) U.S. Cl.
CPC ..... *B21D 22/28* (2013.01); *B21D 22/283* (2013.01); *B21D 51/26* (2013.01)

(58) Field of Classification Search
CPC ..... B21D 22/28; B21D 22/283
See application file for complete search history.

(56) References Cited

U.S. PATENT DOCUMENTS 3,886,781 A * 6/1975 Parannonoff ..... B21D 45/06 72/344
4,173,882 A 11/1979 Lee, Jr.
4,324,124 A * 4/1982 Maeder ..... B21D 22/28 72/345
4,554,815 A * 11/1985 Weishalla ..... B21D 22/28 72/349

(Continued)

FOREIGN PATENT DOCUMENTS

JP S55-19493 A 2/1980
JP H04-500175 A 1/1992

(Continued)

OTHER PUBLICATIONS

Mar. 15, 2016 Written Opinion issued in International Patent Application No. PCT/JP2016/053758.

(Continued)

*Primary Examiner* — Pradeep C Battula
(74) *Attorney, Agent, or Firm* — Oliff PLC

(57) ABSTRACT

An ironing molding device for a metal container includes an annular ironing die carrying out an ironing processing to an outer surface of a cylindrical part of a bottomed cylindrical container by inserting a metallic bottomed cylindrical container disposed at a tip end of a punch sleeve, and a centering ring retainer as a support for a metallic ironing die for supporting said ironing die is provided with a bent elastic piece elastically supporting the ironing die, and the bent elastic piece is provided so as to be bent in a radius direction of said ironing die.

2 Claims, 8 Drawing Sheets

(56) References Cited

U.S. PATENT DOCUMENTS

| | | | | |
|---|---|---|---|---|
| 5,168,742 | A | 12/1992 | Heyes et al. | |
| 2006/0086170 | A1* | 4/2006 | Zauhar | B21D 22/283 72/349 |
| 2018/0133770 | A1* | 5/2018 | Swedberg | B21D 22/28 |

FOREIGN PATENT DOCUMENTS

| | | | |
|---|---|---|---|
| JP | H06-87033 | A | 3/1994 |
| JP | 2003-245731 | A | 9/2003 |
| JP | 2007-216302 | A | 8/2007 |

OTHER PUBLICATIONS

Mar. 15, 2016 Search Report issued in International Patent Application No. PCT/JP2016/053758.

* cited by examiner

IRONING MOLDING DEVICE FOR METAL CONTAINER, AND SUPPORT FOR IRONING DIE

FIELD OF THE INVENTION

This invention relates to an ironing molding device for a metal container which carries out ironing molding processing to a metallic bottomed cylindrical container and manufactures the metal container such as DI can or the like, and to a support for ironing die supporting the ironing die used for the ironing processing of the metal container such as DI can or the like.

DESCRIPTION OF THE RELATED ART

A conventional DI can for containing carbonated drink and beer is normally molded in a manner that a flat coil stock is drawn along a bottomed cylindrical mold, and its cylindrical part is gradually ironed. When a can body is molded, a punch sleeve is inserted inside a bottomed cylindrical container, which is sequentially inserted in a plurality of ironing dies. Accordingly, an inside of each ironing dies comes in contact with an outer surface of a cylindrical part and the bottomed cylindrical container is elongated and so that the can body is molded with a predetermined shape. In case that the ironing dies are fixed, variation (anomaly uneven thickness) may be occurred to thickness of the cylindrical part to be the can body. When damage is occurred at the cylindrical part due to such uneven thickness, the ironing die and the punch sleeve come into contact, and become damaged and short in life thereby.

In order to solve such problems, instead of a completely fix method in which the ironing die is fixed, Patent Document 1 and Non-patent Document 1 disclose an automatic aligning method for supporting the ironing die itself and members of the ironing die to be contact with the cylindrical part, and for preventing damages by reducing load when sudden change in load is occurred in a radial direction of the cylindrical part during ironing processing.

PRIOR ART

Patent Document

Patent Document 1: Japanese Patent Laid-Open Publication S55-19493

Non-Patent Document

Non Patent Document 1: on Dec. 4, 2014, Internet URL: http://www.pridecan.com/toolpack-detail.html

Problem to be Solved by the Invention

According to a technology of the automatic aligning method, aligning is carried out by metallic fingers 23. When the fingers having such shape is used, as shown FIG. 6 by an alternate long and short dash line to understand the present invention, an amount of eccentricity is small, the metallic fingers may be relatively easily broken if a sudden large load are added during the ironing processing.

According to a technology of an automatic aligning method of the Non-Patent Document 1, aligning is carried out by an elastic force of a coil spring, as shown FIG. 6 by an alternate long and two short dashes line to understand the present invention, an amount of eccentricity may be large due to a characteristic of the coil spring. When a material is high in an elastic modulus is used taking the large load to be added into consideration, the amount of eccentricity becomes small just after beginning of processing at which the load is small, and variation (anomaly uneven thickness) may be generated at the cylindrical part to be the can body. On the other hand, when a coil spring being small in elastic modulus is used, the amount of eccentricity becomes so large in case that the large load is added during the ironing processing, and damages may be occurred at the cylindrical part to be the can body. Furthermore, there is relatively easily occurred fatigue to the coil spring of the Non-Patent Document 1 by continuous use, therefore, it is not suitable in view of endurance.

The present invention is made taking the above problems into consideration, and an object of this invention is to provide an ironing molding device for a metal container which is capable of obtaining the metal container of high quality and a support for ironing die, which sufficiently secure an amount of eccentricity of ironing dies not so as to occur uneven thickness at a cylindrical part when only a relative small load is added in a radius direction of the ironing dies during the ironing processing at the cylindrical part, and which prevent damages from occurring at the cylindrical part or a device by controlling so that the amount of eccentricity does not become excessively large in case that a large load is added in a radius direction of the ironing die.

Means for Solving the Problem

According to the present invention, there is provided an ironing molding device for a metal container comprising an annular ironing die carrying out an ironing processing to an outer surface of a cylindrical part of a bottomed cylindrical container by inserting a metallic bottomed cylindrical container disposed at a tip end of a punch sleeve, wherein a support for a metallic ironing die for supporting said ironing die is provided with a bent elastic piece elastically supporting said ironing die, and said bent elastic piece is provided so as to be bent in a radius direction of said ironing die.

According to the present invention, there is provided an ironing molding device for a metal container, wherein an angle of bending of said bent elastic piece is sharp.

According to the present invention, there is provided an ironing molding device for a metal container, wherein said support for the ironing die is formed annular, a plurality of elastic pieces are intermittently arranged in a circumferential direction, and an outer surface of said ironing die is supported by the plurality of elastic pieces.

According to the present invention, there is provided an ironing molding device for a metal container, wherein said bent elastic piece comprises a base end piece extruding from one end of said support for the ironing die, and a tip end piece supporting the ironing die, said base end piece is configured to be bent in a radius direction of said ironing die as said one end is fulcrum, and said tip end piece is configured to be bent in a radius direction of said ironing die as a connecting part connecting the tip end piece and said base end piece is fulcrum, when load is added in the radius direction of said ironing die during the ironing processing and the ironing die is made eccentric, at a stage of small loading, said base end piece and said tip end piece are bent at the same time and said ironing die is made eccentric, and at a stage of large load, said base end piece is configured to control its movement by contacting members arranged nearby, and said ironing die is controlled so that the an amount of eccentricity does not increase.

According to the present invention, there is provided a support for an ironing die for supporting an annular ironing die carrying out an ironing processing to an outer surface of a cylindrical part of a bottomed cylindrical container by inserting a metallic bottomed cylindrical container disposed at a tip end of a punch sleeve, wherein a bent elastic piece elastically supporting said ironing die is formed, and the bent elastic piece is provided so as to be bent in a radius direction of said ironing die.

According to the present invention, there is provided a support for an ironing die wherein an angle of bending of said bent elastic piece is sharp.

According to the present invention, there is provided a support for an ironing die wherein said support for said ironing die is formed annular, a plurality of elastic pieces are intermittently arranged in a circumferential direction, and an outer surface of said ironing die is supported by the plurality of elastic pieces.

According to the present invention, there is provided a support for an ironing die wherein said bent elastic piece comprises a base end piece extruding from one end of said support for the ironing die, and a tip end piece supporting the ironing die, when said ironing die is supported by said support for an ironing die, said base end piece is configured to be bent in a radius direction of said ironing die as said one end is fulcrum, and said tip end piece is configured to be bent in a radius direction of said ironing die as a connecting part connecting the tip end piece and said base end piece is fulcrum, when load is added in the radius direction of said ironing die during the ironing processing and the ironing die is made eccentric, even at a stage of small loading, said base end piece and said tip end piece are bent at the same time and an amount of eccentricity is secured so that said ironing die is make eccentric.

Effect of Invention

According to the present invention, an elastic piece having a base end piece and a tip end piece of a support for an ironing die are formed in bending shape, and the ironing die can be sufficiently eccentric so that the uneven thickness is not occurred at a cylindrical part even if a load at an early stage of ironing processing is small. Additionally, when a relative large load is added during the ironing processing, the base end piece is configured to control its movement by contacting members arranged nearby, and the ironing die is controlled so that the an amount of eccentricity does not become excessively large even if the relative large load is occurred. Therefore, it can be avoided that the amount of eccentricity of ironing dies becomes unnecessarily large, and damage is occurred at a metal container, the ironing die, or a punch sleeve.

Members elastically supporting the ironing die are an elastic piece having a base end piece and a tip end piece, therefore, fatigue is not relatively easily occurred as a coil spring and endurance can be improved.

PREFERRED EMBODIMENT

Hereinafter, description will be made for embodiments of the present invention. The present invention can be easily applied to other than that explained in the embodiments within a scope of the invention.

Embodiment 1

A tool pack 1 as an ironing molding device for a metal container in Embodiment 1 is used for applying press spreading processing to a metallic bottomed cylindrical container W consisting of aluminum to be a metal container, and manufacturing a DI can.

Figure 1:
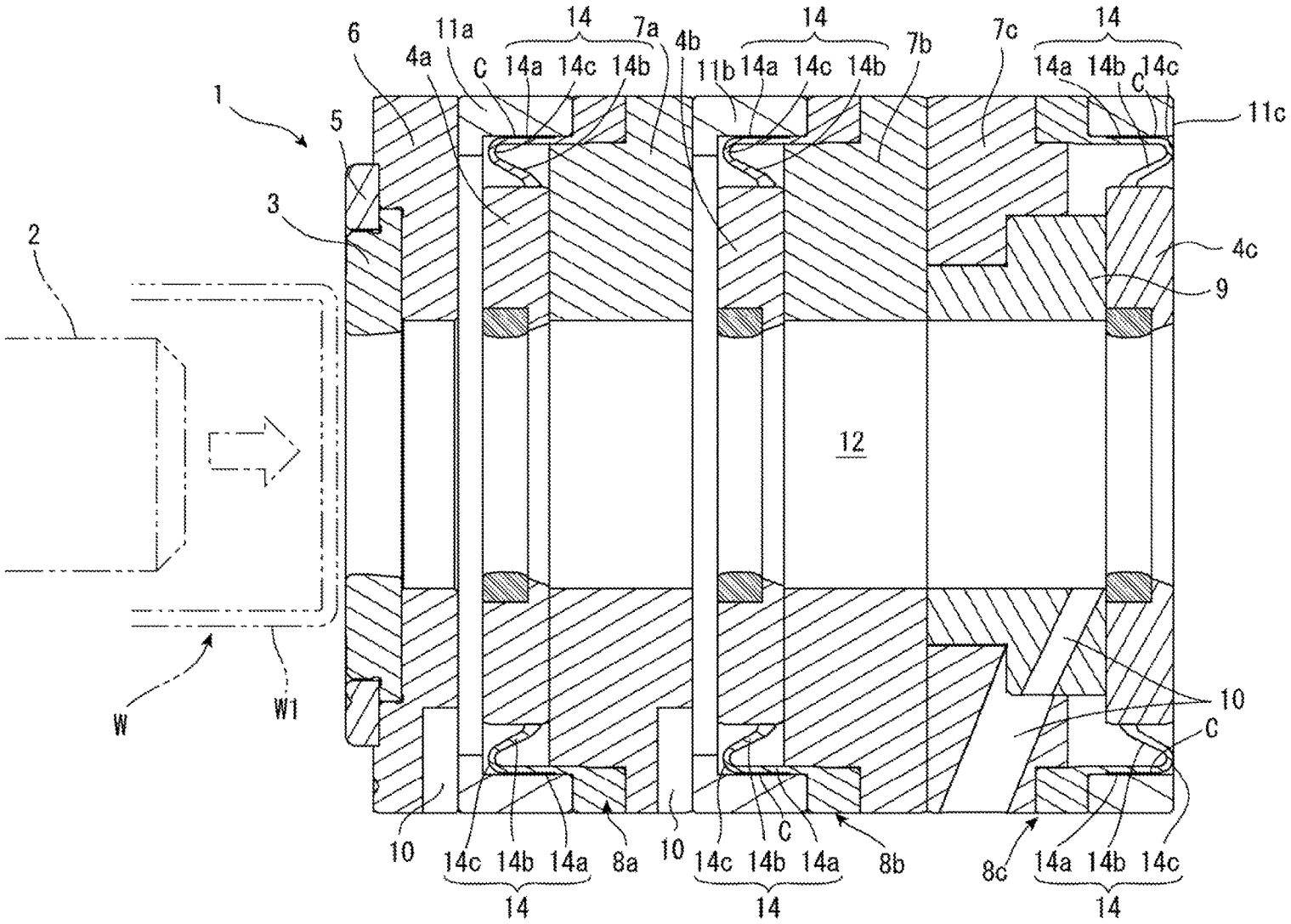
FIG. 1 is a cross sectional view schematically showing a tool pack of an ironing molding device for a metal container according to Embodiment 1.

As shown in FIG. 1, the tool pack 1 is separately provided with a plurality of dies (redrawing die 3 and the first to the third ironing dies 4*a*, 4*b*, 4*c*) in a backward and forward direction of a punch sleeve 2 (a horizontal direction shown in FIG. 1). The ironing die according to the Embodiment 1 comprises a first ironing die 4*a*, a second ironing die 4*b* and a third ironing die 4*c*. The redrawing die 3 is arranged in upstream side of the first ironing die 4*a*, and the redrawing die 3 is fixed on a redrawing die holder 6 by a clamping ring 5.

A first centering ring retainer 7*a* is provided with a first centering ring 8*a* for supporting the first ironing die 4*a*. Similarly, a second centering ring retainer 7*b* is provided with a second centering ring 8*b* for supporting the second ironing die 4*b*, and a third centering ring retainer 7*c* adjacent to the second centering ring retainer 7*b* is provided with a third centering ring 8*c* for supporting the third ironing die 4*c*.

An inside of the third centering ring retainer 7*c* is provided with a lubricator ring 9, the lubricator ring 9, the first and the third centering ring retainers 7*a* and 7*c*, and the redrawing die holder 6 are provided with coolant liquid supply holes 10, respectively for supplying coolant liquid.

In order to provide a predetermined space between the redrawing die holder 6 and the first ironing die 4*a*, a first spacer 11*a* is arranged therebetween. In order to provide a predetermined space between the first centering ring retainer 7*a* and the second ironing die 4*b*, a second spacer 11*b* is arranged therebetween.

Each of the redrawing die 3, the redrawing die holder 6, the first to third ironing dies 4*a* to 4*c*, the first and second centering ring retainer 7*a*, 7*b*, and the lubricator ring 9 are provided with a annular hole part 12 to which the punch sleeve 2 is inserted. These hole parts 12 are arranged concentrically in a backward and forward direction of the punch sleeve 2. The metallic bottomed cylindrical container W to be processed with the punch sleeve 2 is passed through the hole part 12 of the redrawing die 3, and the drawing processing can be made. Thereafter, the bottomed cylindrical container subject to the drawing processing W is gradually passed through the hole parts 12 of the first, the second, and third ironing dies 4*a*, 4*b*, 4*c* accompanying to the punch sleeve 2 forwarding, and the ironing processing of the bottomed cylindrical container W is made.

Description will be made regarding the centering rings 8*a* to 8*c* elastically supporting the first to the third ironing dies 4*a* to 4*c*. As shown in FIG. 1, the first to the third ironing dies 4*a* to 4*c* has same shape, and the first to the third centering rings 8*a* to 8*c* elastically supporting the first to the third ironing dies 4*a* to 4*c* have also same shape. Description of the first centering ring 8*a* is made referring to FIGS. 1 to 6 while omitting the description regarding the second and the third centering rings 8*b*, 8*c*.

Figure 2:
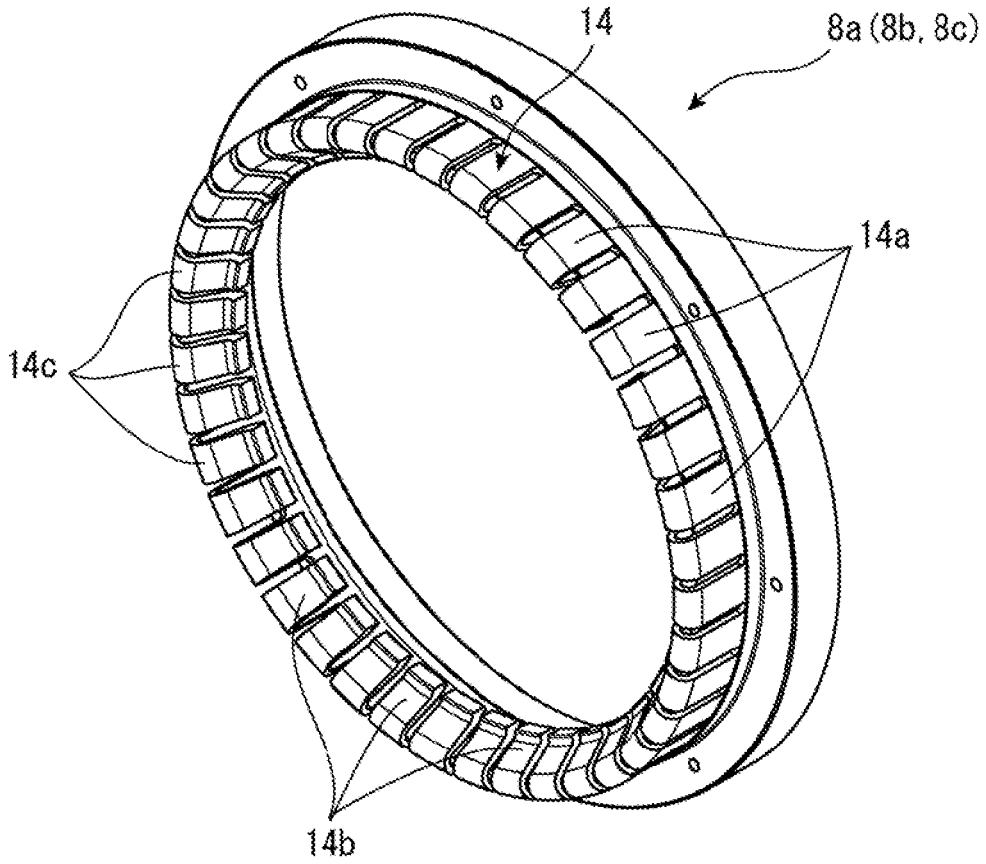
FIG. 2 is a perspective view showing an entering ring as an ironing die support according to Embodiment 1.
Figure 3:
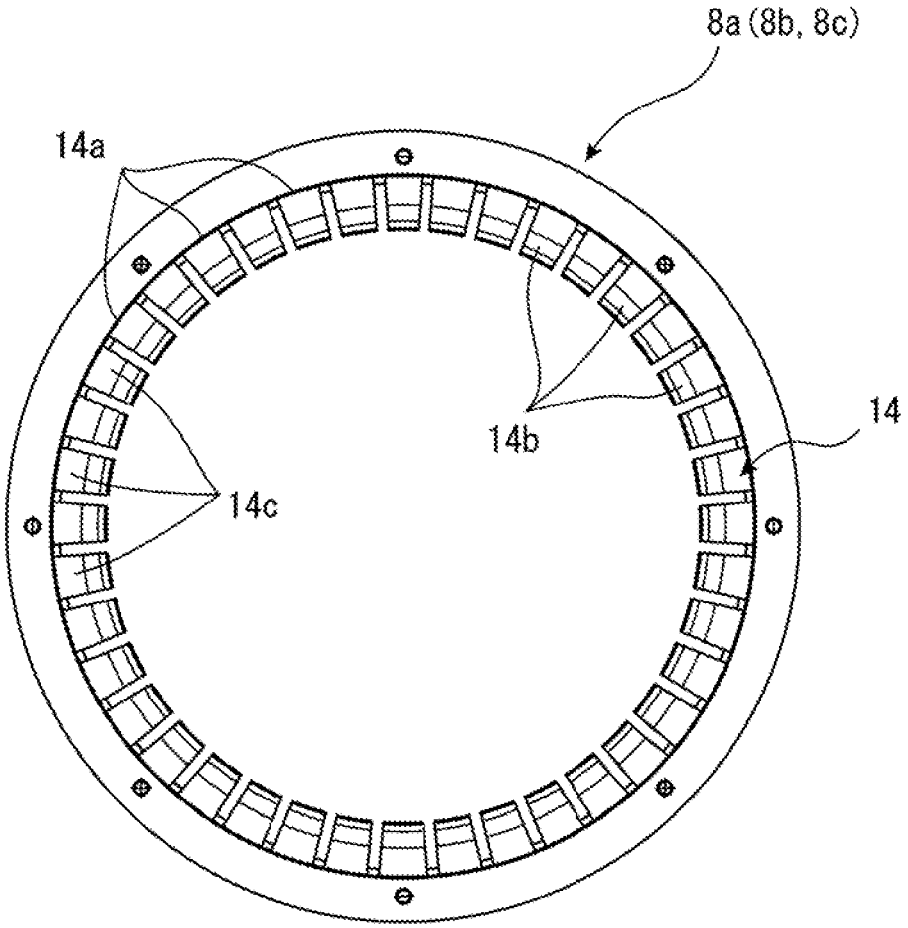
FIG. 3 is a front view showing a centering ring as an ironing die support according to Embodiment 1.
Figure 4:
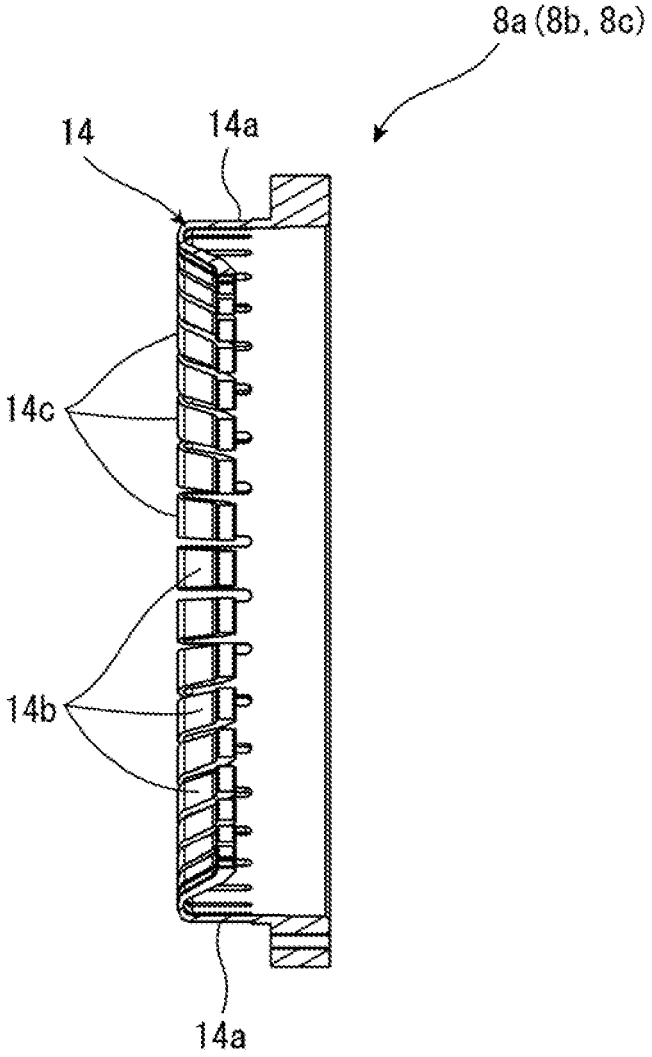
FIG. 4 is a cross sectional view showing a centering ring as an ironing die support according to Embodiment 1.

The first centering ring 8*a* elastically supporting the first ironing die 4*a*, as shown in FIG. 1, is configured to support an outer peripheral surface of the first ironing die 4*a* by a plurality of elastic pieces 14. A plurality of the elastic pieces 14 (40 pieces) are, as shown in FIGS. 2 to 4, intermittently arranged in a circumferential direction of the first centering ring 4*a*. The first centering ring 8*a* comprising the elastic pieces 14 are metallic and are made for cutting process.

Figure 5:
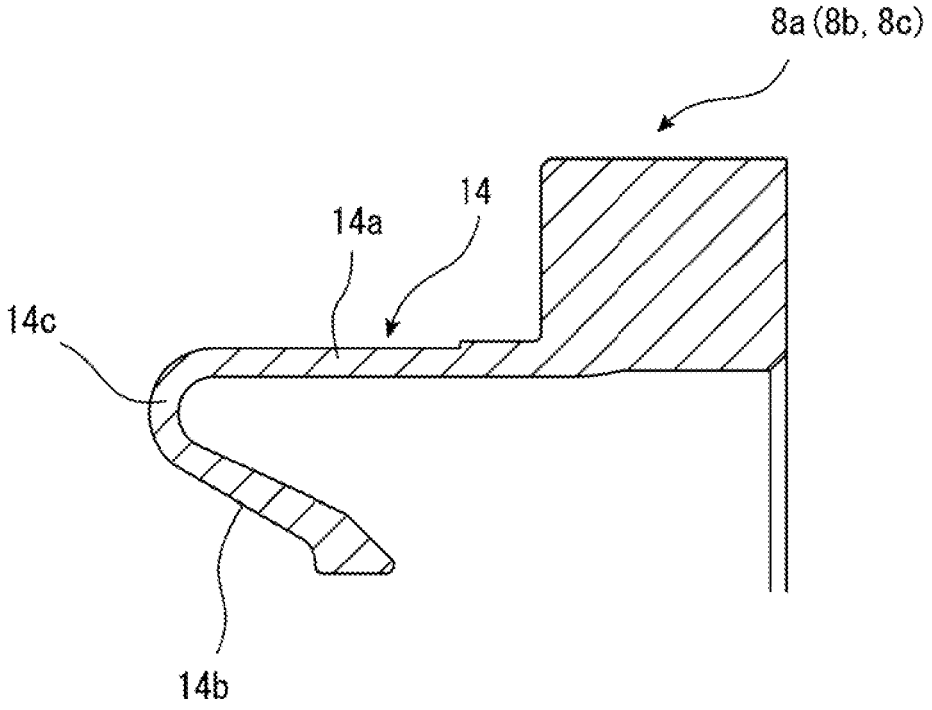
FIG. 5 is an enlarged cross sectional view showing a main part of a centering ring as an ironing die support according to Embodiment 1.

As shown in FIG. 5, the elastic piece 14 is formed in v-shape of the bending having a sharp angle, and comprises a base end piece 14*a* extruding from one end of the first centering ring 8*a*, a tip end piece 14*b* supporting the outer peripheral surface of the first ironing die 4*a*, and a curved connecting part 14*c* for connecting the base end part 14*a* and the tip end piece 14*b*. As shown in FIG. 1, when the first centering ring 8*a* is arranged to the tool pack 1, a clearance c is made in a back side of the base end piece 14*a*. The base end piece 14*a*, the tip end piece 14*b* and the connecting part 14*c* are arranged in a radius direction of the first ironing die 4*a* in a flexible state, the first ironing die 4*a* is made eccentric in the radius direction when load is added in a radius direction of the first ironing die 4*a* during the ironing processing.

Figure 6:
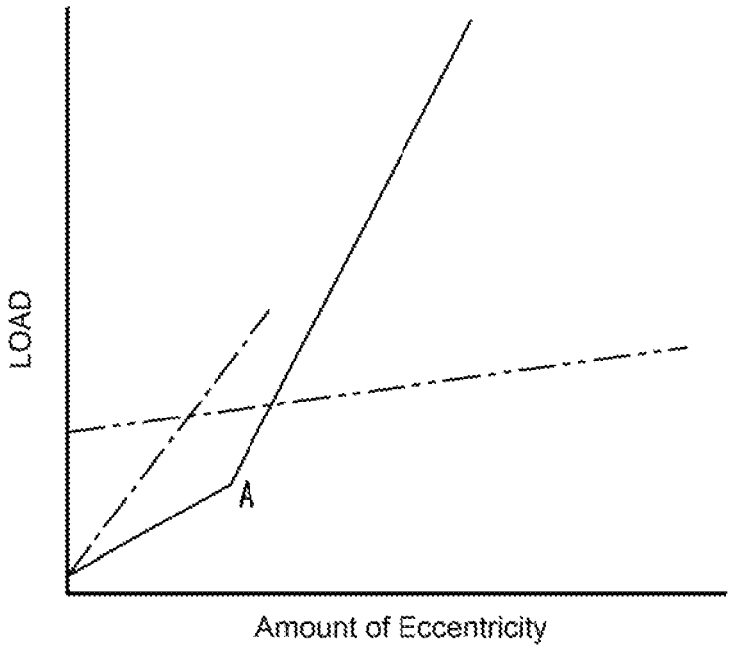
FIG. 6 is a graph to be provided as a reference for understanding the present invention, and a solid line shows relationship between load and an amount of eccentricity when an ironing die is elastically supported by a centering ring according to Embodiment 1, an alternate long and short dash line shows relationship between load and an amount of eccentricity when a casing corresponding to an ironing die is elastically supported by fingers of Patent Document 1, and an alternate long and two short dash line shows relationship between load and an amount of eccentricity when an ironing die is elastically supported by a coil spring of Non-Patent Document 1.

Description will be made of relationship between the load and the amount of eccentricity during the ironing processing of the bottomed cylindrical container W by using the first ironing die 4*a* in FIG. 6. In FIG. 6, the ordinate is the load, and abscissa is the amount of eccentricity. As shown in the figure, when the tool pack 1 of the embodiment 1 is applied and the ironing processing is carried out, as shown by the solid line in FIG. 6, the amount of eccentricity can be relatively large even at an early stage having small load. When the load gradually becomes large, inclination of the solid line becomes larger than that at the early stage from a certain point (inflection point A). As apparent from such an elastic characteristic line which inclination is gentle at the early stage, and elastic modulus is changed from a certain point (namely, inclination becomes large), the elastic piece 14 of the embodiment 1 controls so that the amount of the eccentricity does not become large when the load is large. At the early stage having a small load, the entire elastic piece (base end piece 14*a*, the tip end piece 14*b* and the connecting part 14*c*) are in a flexible state, and the amount of the eccentricity can be largely secured. On the other hand, at a stage having a large load, the base end piece 14*a* comes into contact the first spacer 11*a* arranged in back side, the amount of eccentricity is controlled, and control is made so that the amount of eccentricity of the first ironing die 4*a* is not excessively increased.

According to the invention of the Embodiment 1 as mentioned above, the elastic piece 14 bent at a sharp angle for elastically supporting the first to the third ironing dies 4*a* to 4*c* is formed at the first to the third metallic centering ring 8*a* to 8*c*, the bent elastic piece 14 at least comprises the base end piece 14*a* extruding from one end of the first to the third centering rings 8*a* to 8*c*, and the tip end piece 14*b* supporting the first to the third ironing dies 4*a* to 4*c*. The base end piece 14*a* is configured to be bent in a radius direction of the first to the third ironing dies 4*a* to 4*c* as one end of the first to the third centering rings 8*a* to 8*c* are fulcrums, the tip end piece 14*b* is configured to be bent in a radius direction of the first to the third ironing dies 4*a* to 4*c* as the curved connecting part 14*c* connecting the tip end piece 14*b* and the base end piece 14*a* is fulcrum. When the load is added in the radius direction of the first to the third ironing dies 4*a* to 4*c* during the ironing processing and the first to the third ironing dies 4*a* to 4*c* are made eccentric, at a stage of small loading, the base end piece 14*a* of a thin plate, the tip end piece 14*b* of a thin plate, and curved connecting part 14*c* of a thin plate are bent at the same time, and the first to the third ironing dies 4*a* to 4*c* are made eccentric. At a stage of large bad having strong shocks, the base end piece 14*a* is configured to control its movement by contacting the first to the third spacer 11*a* to 11*c* as members arranged nearby, and the first to the third ironing dies 4*a* to 4*c* is controlled so that the an amount of eccentricity does not become excessively large. Even at the early stage of the ironing processing having the small load, the first to the third ironing dies 4*a* to 4*c* are sufficiently made eccentric so that uneven thickness does not occur at the cylindrical part W1 of the bottomed cylindrical container W. Furthermore, if a relative large load is generated during the ironing processing, the base end piece 14*a* is configured to control its movement by contacting the first to the third spacer 11*a* to 11*c* arranged nearby, and the first to the third ironing dies 4*a* to 4*c* is controlled so that the an amount of eccentricity does not become excessively large. As a result, it can be avoided that the amount of eccentricity of the first to the third ironing dies 4*a* to 4*c* becomes unnecessarily large, and damage is occurred at a metal container as the bottomed cylindrical container W, the first to the third ironing dies 4*a* to 4*c*, or the punch sleeve 2.

Furthermore, members elastically supporting the first to the third ironing dies 4*a* to 4*c* are metallic elastic pieces in a thin plate shape comprising the base end piece 14*a*, the tip end piece 14*b*, the connecting part 14*c*, and fatigue is not relatively easily occurred as the coil spring, and endurance can be improved.

The bent elastic piece 14 is formed with a sharp angle not an obtuse angle, and space for the elastic piece 14 can be small and it can be achieved to make the tool pack compact.

Embodiment 2

Figure 7:
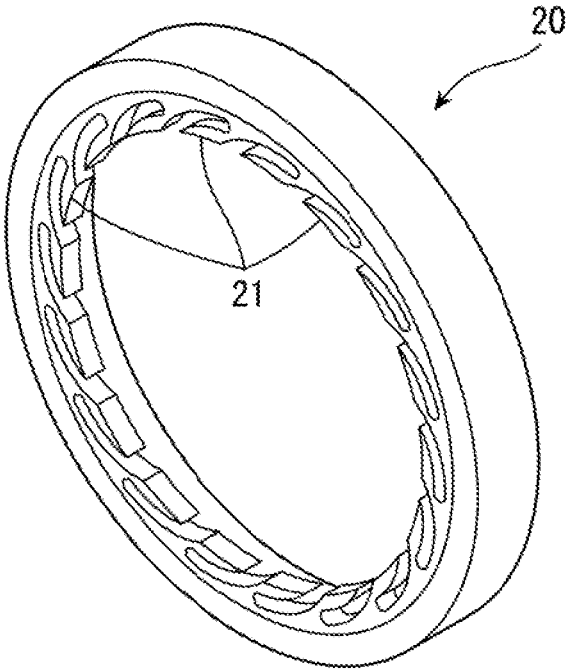
FIG. 7 is a perspective view showing a centering ring as an ironing die support according to Embodiment 2.
Figure 8:
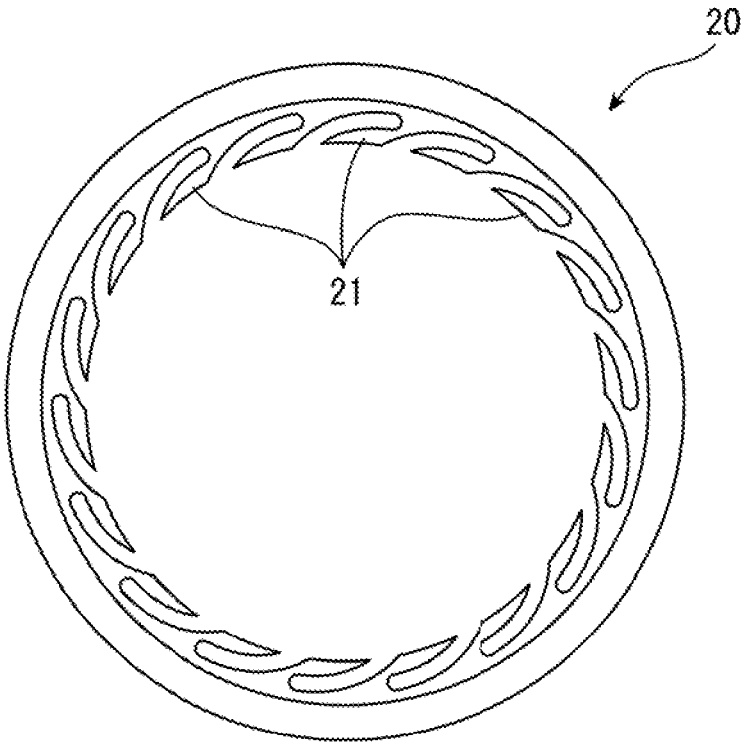
FIG. 8 is a front view showing a centering ring as an ironing die support according to Embodiment 2.

Next, description will be made of Embodiment 2. A centering ring 20 (an ironing die support) corresponds to first to the third centering rings (an ironing die support) 8*a*, 8*b*, and 8*c* of the Embodiment 1. Namely, the centering ring 20 elastically supports the ironing dies and, as shown in FIGS. 7 and 8, a plurality of wave-shaped elastic pieces 21 are intermittently arranged inside the centering ring 20 in a circumferential direction. When load is added during the ironing processing, the elastic piece 21 are bent outwardly of the radius direction and the ironing dies are made eccentric. If large load is added, outside of the wave-shaped elastic piece 21 comes contact with an inner peripheral wall surface and an amount of eccentricity can be controlled. The centering ring (the ironing die support) 20 of the Embodiment 2 also has an elastic characteristic line having an inflexion point A shown by the solid line in FIG. 6, and it can be avoided that the amount of eccentricity of the ironing die becomes unnecessarily large when a relative large load is added.

REFERENCE NUMERALS

1. tool pack (ironing device for metal container)
2. punch sleeve
3. redrawing die
4*a*. first ironing die
4*b*. second ironing die
4*c*. third ironing die
5. clamping ring
6. redrawing die holder
7*a*. first centering ring retainer
7*b*. second centering ring retainer
7*c*. third centering ring retainer
8*a*. first centering ring (ironing die support)
8*b*. second centering ring (ironing die support)
8*c*. third centering ring (ironing die support)
9. lubricator ring
10. coolant liquid supply hole
11*a*. first spacer
11*b*. second spacer
11*c*. third spacer
12 hole part
14. elastic piece
14*a* base end piece
14*b*. tip end piece
14*c*. connecting part
20. centering ring (ironing die support)
21. elastic piece
A. inflexion point
C. clearance
W. bottomed cylindrical container
W1. cylindrical part

The invention claimed is:

1. An ironing molding device for a metal container, the ironing molding device comprising:

a metallic annular ironing die for carrying out ironing processing to an outer surface of a cylindrical part of a metallic bottomed cylindrical container by inserting into the ironing die the metallic bottomed cylindrical container disposed at a tip end of a punch sleeve; and a support for the ironing die that includes a bent elastic piece elastically supporting the ironing die, the bent elastic piece being bent in a radius direction of the ironing die that is perpendicular to an axis of the ironing die, wherein:

an angle of bending of the bent elastic piece is a sharp angle, the bent elastic piece comprises (i) a base end piece extruding from one end of the support and (ii) a tip end piece supporting the ironing die, the base end piece is configured to be bent in the radius direction of the ironing die so that the one end of the support acts as a fulcrum, and the tip end piece is configured to be bent in the radius direction of the ironing die such that a connecting part connecting the tip end piece and the base end piece acts as a fulcrum, and when load is added in the radius direction of the ironing die during the ironing processing and the ironing die is made eccentric, at a stage of small loading, the base end piece and the tip end piece are bent at the same time and the ironing die is made eccentric, and at a stage of large load, the base end piece is configured to control its movement by contacting members arranged nearby, and the ironing die is controlled so that an amount of eccentricity does not increase.

2. The ironing molding device for a metal container according to claim 1, wherein the support for the ironing die is formed annularly, the bent elastic piece is one of a plurality of elastic pieces that are intermittently arranged in a circumferential direction, and an outer surface of the ironing die is supported by the plurality of elastic pieces.

* * * * *